US011015273B2

(12) United States Patent
Yoshida et al.

(10) Patent No.: US 11,015,273 B2
(45) Date of Patent: May 25, 2021

(54) WEB FORMING DEVICE AND SHEET MANUFACTURING APPARATUS

(71) Applicant: SEIKO EPSON CORPORATION, Tokyo (JP)

(72) Inventors: Makoto Yoshida, Nagano (JP); Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 190 days.

(21) Appl. No.: 16/464,360

(22) PCT Filed: Nov. 8, 2017

(86) PCT No.: PCT/JP2017/040252
§ 371 (c)(1),
(2) Date: May 28, 2019

(87) PCT Pub. No.: WO2018/100989
PCT Pub. Date: Jun. 7, 2018

(65) Prior Publication Data

US 2021/0115606 A1 Apr. 22, 2021

(30) Foreign Application Priority Data

Nov. 29, 2016 (JP) ..... JP2016-231152

(51) Int. Cl.
*D04H 1/732* (2012.01)
*B27N 3/04* (2006.01)
(Continued)

(52) U.S. Cl.
CPC ..... *D04H 1/732* (2013.01); *B27N 3/04* (2013.01); *D01B 1/08* (2013.01); *D04H 1/60* (2013.01); *D21F 9/00* (2013.01)

(58) Field of Classification Search
None
See application file for complete search history.

(56) References Cited

U.S. PATENT DOCUMENTS 4,615,767 A * 10/1986 Miers ..... D21B 1/08 162/4
2008/0113052 A1* 5/2008 Van Valkenburgh ..... A61F 13/15626 425/2
2016/0273164 A1 9/2016 Omagari et al.

FOREIGN PATENT DOCUMENTS

JP 2016-175403 A 10/2016

* cited by examiner

*Primary Examiner* — Mary Lynn F Theisen
(74) *Attorney, Agent, or Firm* — Global IP Counselors, LLP

(57) ABSTRACT

A housing portion includes first and second inclined surfaces facing each other and inclined such that a distance between the first and second inclined surfaces decreases downward in a vertical direction. A third inclined surface located between the first and second inclined surfaces, facing the first inclined surface, inclined such that a distance between the third and first inclined surfaces decreases downward in the vertical direction, and having a first gap with respect to the first inclined surface is provided. A fourth inclined surface located between the first and second inclined surfaces, facing the second inclined surface, inclined such that a distance between the fourth and second inclined surfaces decreases downward in the vertical direction, and having a second gap with respect to the second inclined surface is provided. A suction blower causes a mixture to pass through the first and second gaps, and collects the mixture.

9 Claims, 9 Drawing Sheets

(51) Int. Cl.

| | |
|---|---|
| ***D21F 9/00*** | (2006.01) |
| ***D04H 1/60*** | (2006.01) |
| ***D01B 1/08*** | (2006.01) |

WEB FORMING DEVICE AND SHEET MANUFACTURING APPARATUS

CROSS-REFERENCE TO RELATED APPLICATIONS

This application is a U.S. National stage application of International Patent Application No. PCT/JP2017/040252, filed on Nov. 8, 2017, which claims priority under 35 U.S.C. § 119(a) to Japanese Patent Application No. 2016-231152, filed in Japan on Nov. 29, 2016. The entire disclosure of Japanese Patent Application No. 2016-231152 is hereby incorporated herein by reference.

TECHNICAL FIELD

The present invention relates to a web forming device and a sheet manufacturing apparatus.

BACKGROUND ART

Hitherto, a sheet is manufactured by depositing a fiber-like substance and causing cohesion to act between the deposited fibers.

In this case, for example, a sheet manufacturing apparatus that forms a web by depositing, on a mesh belt, a mixture (a defibrated object and an additive) which passed through an opening of a deposition section, and forms a sheet by pressing and heating the web (for example, see Japanese Unexamined Patent Application Publication No. 2016-175403).

However, with the related art technology, the mixture which passed through the mesh belt may stay in a suction mechanism that sucks the mixture, the mixture may not be uniformly sucked, and the thickness of the web deposited on the mesh belt may be uneven.

SUMMARY

To address the above-described problem, an object of the invention is to uniformly suck a mixture with a suction mechanism of a web forming device and a sheet manufacturing apparatus.

To attain the above-described object, a web forming device according to the invention includes a mesh body that has a deposition surface on which a mixture including a defibrated object and a resin is deposited as a web and that transports the deposited web; a housing portion located on a back surface side of the deposition surface of the mesh body and defining a suction region; and a suction portion that sucks air in the housing portion. The housing portion includes a first inclined surface and a second inclined surface inclined such that a distance between the first inclined surface and the second inclined surface decreases downward in a vertical direction and arranged to face each other; a third inclined surface that is located between the first inclined surface and the second inclined surface, that faces the first inclined surface, that is inclined such that a distance between the third inclined surface and the first inclined surface decreases downward in the vertical direction, and that has a first gap with respect to the first inclined surface; and a fourth inclined surface that is located between the first inclined surface and the second inclined surface, that faces the second inclined surface, that is inclined such that a distance between the fourth inclined surface and the second inclined surface decreases downward in the vertical direction, and that has a second gap with respect to the second inclined surface. The suction portion causes the mixture which passed through a mesh of the mesh body to pass through the first gap and the second gap and collects the mixture.

With the invention, when the suction portion sucks the air, the wind speed at the first gap and the second gap is high. Hence, the mixture that falls to the first gap and the second gap passes through the first gap and the second gap at a high speed and can be collected. Thus, the mixture is not deposited in the housing portion, and a uniform flow of the air can be generated in the housing portion. Consequently, the mesh belt can be uniformly sucked, and a second web can be uniformly deposited on the mesh belt.

Also, in the invention, a transport member communicating with the suction portion and having an opening through which the mixture which passed through the first gap and the second gap passes is provided on a bottom portion of the housing portion.

With the invention, the mixture which passed through the first gap and the second gap at a high speed can be sucked through the opening of the transport member.

Also, in the invention, the housing portion includes a first partition wall extending from an end portion of the third inclined surface near the first gap toward the transport member, and a second partition wall extending from an end portion of the fourth inclined surface near the second gap toward the transport member.

With the invention, since the first partition wall and the second partition wall define spaces directly below the first gap and the second gap, the mixture which passed through the first gap and the second gap can be stirred, and the mixture can be easily sucked.

Also, in the invention, inclination angles of the first inclined surface, the second inclined surface, the third inclined surface, and the fourth inclined surface each are larger than an angle of repose of the mixture.

With the invention, the mixture which fell on the first inclined surface, the second inclined surface, the third inclined surface, and the fourth inclined surface can quickly fall in the first gap and the second gap.

Also, in the invention, inclination angles of the first inclined surface, the second inclined surface, the third inclined surface, and the fourth inclined surface each are larger than an angle of repose of a material, the angle of repose being the largest among angles of repose of materials that constitute the mixture.

With the invention, the mixture which fell on the first inclined surface, the second inclined surface, the third inclined surface, and the fourth inclined surface can quickly fall in the first gap and the second gap.

Also, in the invention, the third inclined surface and the fourth inclined surface are constituted of a roof member in which the third inclined surface and the fourth inclined surface are coupled to each other in a gable shape at a top portion.

Accordingly, with the roof member, the third inclined surface and the fourth inclined surface can be integrally formed. In addition, the mixture is not deposited on the top portion between the third inclined surface and the fourth inclined surface.

Also, in the invention, a fifth inclined surface and a sixth inclined surface that are located between the third inclined surface and the fourth inclined surface, that are inclined such that a distance between the fifth inclined surface and the sixth inclined surface decreases downward in the vertical direction, and that face each other are provided. Inclination angles of the fifth inclined surface and the sixth inclined surface each are larger than the angle of repose.

With the invention, when the suction portion sucks the air, the mixture which falls on the fifth inclined surface and the sixth inclined surface passes between (through the gap between) both the inclined surfaces at a high speed and can be collected. Thus, the mixture is not deposited in the housing portion, and the uniform flow of the air can be generated in the housing portion. Consequently, the web can be uniformly deposited on the mesh body.

A sheet manufacturing apparatus according to the invention includes the above-described web forming device; and a sheet forming section that applies heat and pressure to a web formed by the web forming device and forms a sheet.

With the invention, a uniform flow of the air can be generated in the housing portion of the web forming section. Hence, the mesh body can be uniformly sucked and the web can be uniformly deposited on the mesh body. Consequently, sheet quality can be stable.

DESCRIPTION OF EMBODIMENTS

Embodiments of the invention are described below with reference to the drawings.

Figure 1:
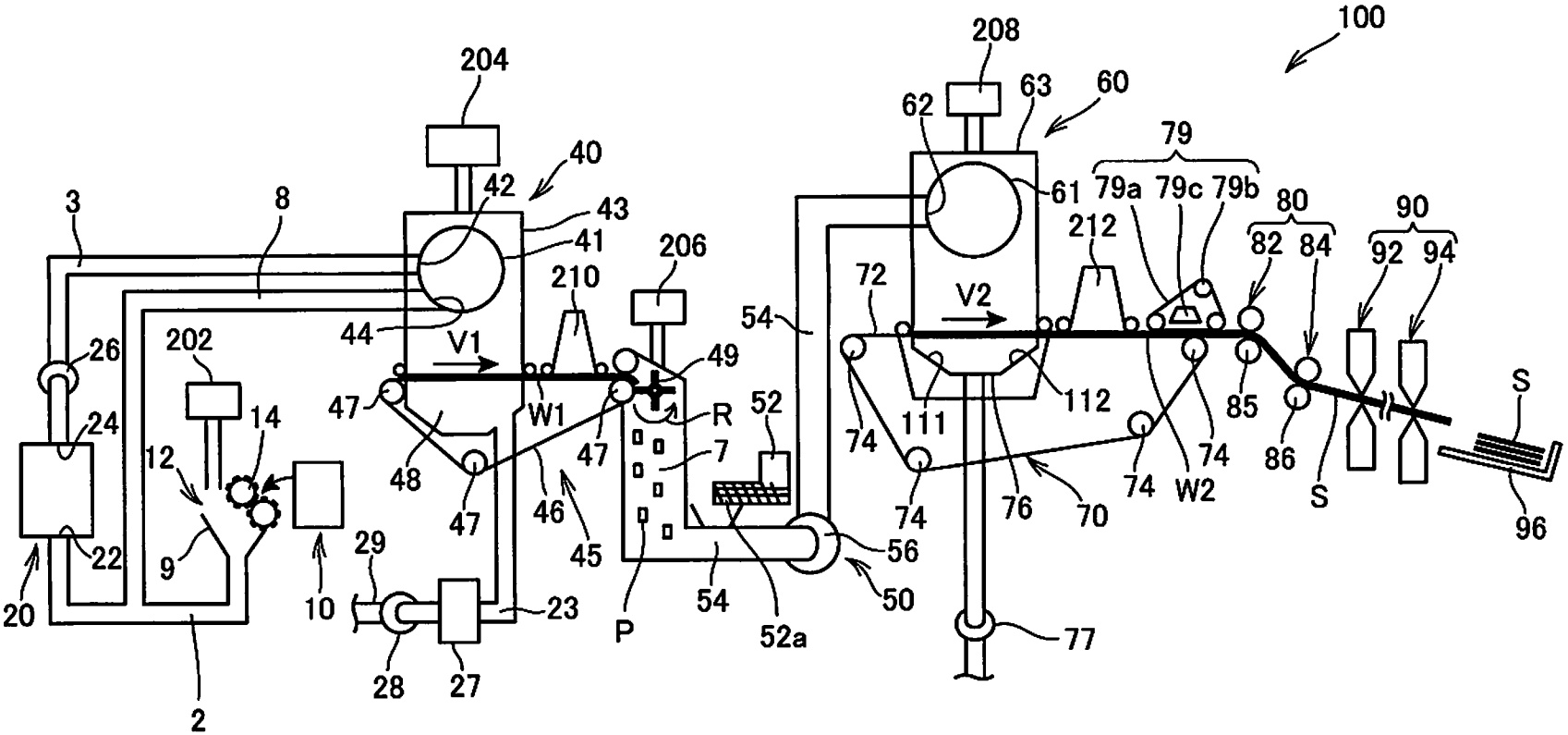
FIG. 1 is a schematic view illustrating a configuration and an operation of a sheet manufacturing apparatus to which the invention is applied.

FIG. 1 is a schematic view illustrating a configuration and an operation of an embodiment of a sheet manufacturing apparatus to which a web forming device of the invention is applied.

A sheet manufacturing apparatus 100 described in this embodiment is, for example, an apparatus suitable for manufacturing new paper by defibrating used paper such as confidential paper serving as a raw material into fibers in a dry process, then applying heat and pressure to the fibers, and cutting the fibers. By mixing various additives into the fiber raw material, the bonding strength and the degree of whiteness of paper products may be increased and functions, such as color, fragrance, and flame retardancy, may be added in accordance with the purpose of use. In addition, by forming paper while the density, thickness, and shape of paper are controlled, paper with various thicknesses and sizes can be manufactured in accordance with the purpose of use, such as office paper of A4 or A3 or paper for business cards.

As illustrated in FIG. 1, the sheet manufacturing apparatus 100 includes a supply section 10, a rough crush section 12, a defibrator 20, a sorting section 40, a first web forming section 45, a rotary body 49, a mixing section 50, a deposition section 60, a second web forming section 70, a transport section 79, a sheet forming section 80, and a cutting section 90.

In addition, the sheet manufacturing apparatus 100 includes humidifying units 202, 204, 206, 208, 210, and 212 for humidifying a raw material and/or humidifying a space in which the raw material moves. Specific configurations of the humidifying units 202, 204, 206, 208, 210, and 212 may be desirably determined and may be, for example, steam type, vaporizing type, warm-air vaporizing type, or ultrasonic type.

In this embodiment, the humidifying units 202, 204, 206, and 208 are constituted of humidifiers of vaporizing type or warm-air vaporizing type. That is, the humidifying units 202, 204, 206, and 208 each have a filter (not illustrated) that is infiltrated with water and transmits air to supply humidifying air having an increased humidity.

In addition, in this embodiment, the humidifying units 210 and 212 are constituted of ultrasonic type humidifiers. That is, the humidifying units 210 and 212 each have a vibrating portion (not illustrated) that atomizes water and that supplies a mist generated by the vibrating portion.

The supply section 10 supplies a raw material to the rough crush section 12. The raw material with which the sheet manufacturing apparatus 100 manufactures a sheet may be any material as long as the material includes fibers. For example, the raw material may be paper, pulp, a pulp sheet, fabric including nonwoven fabric, or woven fabric. In this embodiment, for example, the sheet manufacturing apparatus 100 uses used paper as a raw material.

The rough crush section 12 shreds (roughly crushes) the raw material supplied by the supply section 10, by using a rough crush blade 14, into roughly crushed pieces. The rough crush blade 14 shreds the raw material in a gas such as an atmosphere (air). The rough crush section 12 includes, for example, a pair of rough crush blades 14 that pinch and shred the raw material, and a driving portion that rotates the rough crush blades 14. The rough crush section 12 may have a configuration similar to what-is-called shredder. The shapes and sizes of the rough crush pieces are desirably determined as long as being suitable for defibrating processing by the defibrator 20. For example, the rough crush section 12 shreds the raw material into paper pieces with sizes one to several centimeters square or smaller.

The rough crush section 12 has a chute (a hopper) 9 that receives the roughly crushed pieces shredded by the rough crush blades 14 and fell. The chute 9 has, for example, a tapered shape having a width that gradually decreases in a direction in which the roughly crushed pieces flow (an advance direction). Thus, the chute 9 can receive many roughly crushed pieces. The chute 9 is coupled to a pipe 2 that communicates with the defibrator 20. The pipe 2 defines a transport path for transporting the raw material (the roughly crushed pieces) shredded by the rough crush blades 14 to the defibrator 20. The roughly crushed pieces are collected by the chute 9 and transferred (transported) through the pipe 2 to the defibrator 20.

The humidifying unit 202 supplies humidifying air to the chute 9 of the rough crush section 12 or to the vicinity of the chute 9. Thus, a phenomenon in which a roughly crushed object shredded by the rough crush blades 14 is attracted to the inner surface of the chute 9 or the pipe 2 due to static electricity can be suppressed. In addition, since the roughly crushed object shredded by the rough crush blades 14 is transferred to the defibrator 20 together with the air which was humidified (with high humidity), an advantageous effect of suppressing adhesion of a defibrated object to the inside of the defibrator 20 is expected. Moreover, the humidifying unit 202 may supply the humidifying air to the rough crush blades 14 to eliminate static electricity from the raw material supplied by the supply section 10. Furthermore, static electricity may be eliminated using an ionizer together with the humidifying unit 202.

The defibrator 20 performs defibrating processing on the raw material (the roughly crushed pieces) shredded by the rough crush section 12 and generates a defibrated object. In this case, "defibrating" represents disentangling the raw material (an object to be defibrated) in which a plurality of fibers are bound, into individual fibers. The defibrator 20 also has a function of separating substances, such as resin particles, ink, toner, and an anti-bleed agent, adhering to the raw material from the fibers.

The object which passed through the defibrator 20 is called "defibrated object". The "defibrated object" may include particles of a resin (a resin for binding a plurality of fibers) separated from the fibers when the fibers are disentangled; colorant, such as ink and toner; and additives, such as an anti-bleed agent and a paper strengthening agent, in addition to the disentangled fibers of the defibrated object. The shape of the disentangled defibrated object is a string shape or a ribbon shape. The disentangled defibrated object may be provided in a state in which the defibrated object is not intertwined with the other disentangled fibers (an independent state), or may be provided in a state in which the defibrated object is intertwined with the other disentangled defibrated object and hence is in a block state (a state in which what-is-called "lump" is formed).

The defibrator 20 performs defibrating in a dry process. In this case, executing processing such as defibrating not in a liquid but in a gas such as an atmosphere (air) is called dry process. In this embodiment, the defibrator 20 uses an impeller mill. To be specific, the defibrator 20 includes a rotor (not illustrated) that rotates at a high speed, and a liner (not illustrated) located at the outer periphery of the rotor. The roughly crushed pieces roughly crushed by the rough crush section 12 are pinched between the rotor and the liner of the defibrator 20 and defibrated. The defibrator 20 generates an airflow due to rotation of the rotor. With the airflow, the defibrator 20 can suck the roughly crushed pieces being the raw material from the pipe 2, and transport the defibrated object an outlet port 24. The defibrated object is fed from the outlet port 24 to a pipe 3, and is transferred through the pipe 3 to the sorting section 40.

As described above, the defibrated object generated by the defibrator 20 is transported from the defibrator 20 to the sorting section 40 by the airflow generated by the defibrator 20. Furthermore, in this embodiment, the sheet manufacturing apparatus 100 includes a defibrating-section blower 26 that is an airflow generating device. The airflow generated by the defibrating-section blower 26 transports the defibrated object to the sorting section 40. The defibrating-section blower 26 is attached to the pipe 3, sucks the air together with the defibrated object from the defibrating section 20, and blows the air to the sorting section 40.

The sorting section 40 has an inlet port 42 into which the defibrated object defibrated by the defibrator 20 together with the airflow flows from the pipe 3. The sorting section 40 sorts the defibrated object introduced to the inlet port 42 in accordance with the length of fiber. To be more specific, the sorting section 40 sorts the defibrated object defibrated by the defibrator 20 into a defibrated object with a predetermined size or smaller as a first sorted object, and a defibrated object larger than the first sorted object as a second sorted object. The first sorted object includes fibers, particles, or the like. The second sorted object includes, for example, large fibers, non-defibrated pieces (roughly crushed pieces which are not sufficiently defibrated), and a lump in which defibrated fibers are aggregated or entangled.

In this embodiment, the sorting section 40 has a drum portion (a sieve portion) 41 and a housing portion (a cover portion) 43 that houses the drum portion 41.

The drum portion 41 is a cylindrical sieve that is rotationally driven by a motor. The drum portion 41 has a net (a filter, a screen) and functions as a sieve. With the mesh of the net, the drum portion 41 sorts the defibrated object to the first sorted object smaller than the size of the apertures (openings) of the mesh of the net, and the second sorted object larger than the apertures of the mesh of the net. The net of the drum portion 41 may use, for example, a wire net, an expanded metal obtained by expanding a metal sheet with cuttings, or a punching metal obtained by forming holes in a metal sheet with a press or the like.

The defibrated object introduced to the inlet port 42 is fed into the drum portion 41 together with the airflow, and the first sorted object falls downward from the mesh of the net of the drum portion 41 by rotation of the drum portion 41. The second sorted object which does not pass through the mesh of the net of the drum portion 41 is sent by the airflow flowing into the drum portion 41 from the inlet port 42, guided to an outlet port 44, and fed to a pipe 8.

The pipe 8 couples the inside of the drum portion 41 and the pipe 2 to each other. The second sorted object sent through the pipe 8 flows through the pipe 2 together with the roughly crushed pieces roughly crushed by the rough crush section 12, and is guided to an inlet port 22 of the defibrator 20. Thus, the second sorted object is returned to the defibrator 20 and subjected to the defibrating processing.

The first sorted object sorted by the drum portion 41 is dispersed into the air through the mesh of the net of the drum portion 41, and descends toward a mesh belt 46 of the first web forming section 45 located below the drum portion 41.

The first web forming section 45 (a separating section) includes the mesh belt 46 (a separating belt), a support roller 47, and a suction portion (a suction mechanism) 48. The mesh belt 46 is an endless-form belt, is supported by three support rollers 47, and is transported in a direction indicated by an arrow in the drawing by motions of the support rollers 47. The mesh belt 46 has a surface that is constituted of a net in which openings with a predetermined size are arrayed. Fine particles having sizes that pass through the mesh of the net and included in the first sorted object descending from the sorting section 40 fall to a position below the mesh belt 46; and fibers with sizes that do not pass through the mesh of the net are deposited on the mesh belt 46 and are transported in the arrow direction together with the mesh belt 46. The fine particles falling from the mesh belt 46 include fine particles that are relatively small and have low density (resin particles, a colorant, an additive, etc.) in the defibrated object, and that are an elimination object not to be used by the sheet manufacturing apparatus 100 for manufacturing a sheet S.

The mesh belt 46 moves at a constant speed V1 during a normal operation of manufacturing a sheet S. In this case, "during a normal operation" represents during an operation excluding during execution of start control and stop control of the sheet manufacturing apparatus 100 (described later). To be more specific, "during a normal operation" represents a period in which the sheet manufacturing apparatus 100 manufactures a sheet S with desirable quality.

The defibrated object after the defibrating processing by the defibrator 20 is sorted into the first sorted object and the second sorted object by the sorting section 40. The second sorted object is returned to the defibrator 20. In addition, the elimination object is eliminated from the first sorted object by the first web forming section 45. The residual after the elimination of the elimination object from the first sorted object is a material suitable for manufacturing a sheet S. The material is deposited on the mesh belt 46 and forms a first web W1.

The suction portion 48 sucks the air from below the mesh belt 46. The suction portion 48 is coupled to a dust collector 27 through a pipe 23. The dust collector 27 is a dust collecting device of filter type or cyclone type, and separates the fine particles from the airflow. A collecting blower 28 (a separating and sucking portion) is disposed downstream of the dust collector 27. The collecting blower 28 sucks the air from the dust collector 27. The air output by the collecting blower 28 passes through a pipe 29 and is output to the outside of the sheet manufacturing apparatus 100.

With this configuration, the collecting blower 28 sucks the air from the suction portion 48 through the dust collector 27. In the suction portion 48, the fine particles which passed through the mesh of the net of the mesh belt 46 are sucked together with the air and are fed to the dust collector 27 through the pipe 23. The dust collector 27 separates the fine particles which passed through the mesh belt 46 from the airflow and stores the fine particles.

Thus, the fibers after the elimination object was eliminated from the first sorted object are deposited on the mesh belt 46 and the first web W1 is formed. Since the collecting blower 28 performs the sucking, the formation of the first web W1 on the mesh belt 46 is promoted and the elimination object is quickly eliminated.

The humidifying unit 204 supplies humidifying air to a space including the drum portion 41. The humidifying air humidifies the first sorted object in the sorting section 40. Thus, the adhesion of the first sorted object to the mesh belt 46 due to static electricity is weakened, and the first sorted object can be more easily peeled off from the mesh belt 46. Furthermore, the adhesion of the first sorted object to the rotary body 49 or the inner wall of the housing portion 43 due to static electricity can be suppressed. The suction portion 48 can efficiently suck the elimination object.

In the sheet manufacturing apparatus 100, the configuration that sorts the defibrated object into the first defibrated object and the second defibrated object and separates the first defibrated object and the second defibrated object from each other is not limited to the sorting section 40 including the drum portion 41. For example, a configuration that classifies, by using a classifier, the defibrated object after the defibrating processing by the defibrator 20 may be employed. The classifier may be, for example, a cyclone classifier, an elbow-jet classifier, or an eddy classifier. By using such a classifier, the sorted object can be sorted into the first sorted object and the second sorted object, and the first sorted object and the second sorted object can be separated from each other. Furthermore, with the above-described classifier, a configuration that separates and eliminates the elimination object including fine particles that are relatively small and have low density (resin particles, a colorant, an additive, etc.) can be provided. For example, the classifier may eliminate fine particles included in the first sorted object from the first sorted object. In this case, the second sorted object may be returned to the defibrator 20, the elimination object may be collected by the dust collector 27, and the first sorted object excluding the elimination object may be fed to a pipe 54.

In the transport path of the mesh belt 46, the humidifying unit 210 supplies the air including a mist to a downstream side of the sorting section 40. The mist which is fine particles of water and generated by the humidifying unit 210 descends toward the first web W1 and supplies moisture to the first web W1. Thus, the quantity of moisture contained in the first web W1 is controlled and attraction of fibers to the mesh belt 46 due to static electricity and so forth can be suppressed.

The sheet manufacturing apparatus 100 includes the rotary body 49 that divides the first web W1 deposited on the mesh belt 46. The first web W1 is peeled off from the mesh belt 46 at a position at which the mesh belt 46 is folded back by the support roller 47, and is divided by the rotary body 49.

The first web W1 is a soft material formed in a web shape because fibers are deposited. The rotary body 49 disentangles the fibers of the first web W1 and hence processes the fibers of the first web W1 so that resin can be easily mixed to the fibers by the mixing section 50 (described later).

The configuration of the rotary body 49 is desirably determined. In this embodiment, the rotary body 49 may have a rotary blade shape having a plate-shaped blade and being rotatable. The rotary body 49 is arranged at a position at which the blade contacts the first web W1 to be peeled off from the mesh belt 46. With the rotation (for example, rotation in a direction indicated by arrow R in the drawing) of the rotary body 49, the blade collides with and subdivides the first web W1 transported while being peeled off from the mesh belt 46, and hence generates subdivided bodies P.

The rotary body 49 is desirably disposed at a position at which the blade of the rotary body 49 does not collide with the mesh belt 46. For example, the distance between the tip end of the blade of the rotary body 49 and the mesh belt 46 can be in a range of from 0.05 mm to 0.5 mm. In this case, the rotary body 49 can efficiently subdivide the first web W1 without giving damage on the mesh belt 46.

The bodies P subdivided by the rotary body 49 descend in a pipe 7, and are transferred (transported) to the mixing section 50 by an airflow flowing in the pipe 7.

In addition, the humidifying unit 206 supplies humidifying air to a space including the rotary body 49. Thus, a phenomenon in which fibers are attracted to the inside of the pipe 7 or the blade of the rotary body 49 due to static electricity can be suppressed. Moreover, since the air with high humidity is supplied through the pipe 7 to the mixing section 50, the influence of static electricity can be suppressed also in the mixing section 50.

The mixing section 50 includes an additive supply portion 52 that supplies an additive including a resin, a pipe 54 that communicates with the pipe 7 and through which the airflow including the subdivided bodies P flows, and a mixing blower 56 (a transfer blower).

The subdivided bodies P are the fibers obtained by eliminating the elimination object from the first sorted object which passed through the sorting section 40 as described above. The mixing section 50 mixes an additive including a resin to the fibers that constitute the subdivided bodies P.

In the mixing section 50, the mixing blower 56 generates an airflow and transports the subdivided bodies P and the additive while mixing the subdivided bodies P and the additive together in the pipe 54. The subdivided bodies P are disentangled in the process of flowing through the inside of the pipe 7 and the pipe 54, and become further fine fibers.

The additive supply portion 52 (a resin housing portion) is coupled to an additive cartridge (not illustrated) that stores an additive, and supplies the additive in the additive cartridge to the pipe 54. The additive cartridge may be detachably attached to the additive supply portion 52. In addition, a configuration that supplements the additive to the additive cartridge may be provided. The additive supply portion 52 temporarily stores an additive formed of fine powder or fine particles in the additive cartridge. The additive supply portion 52 has an output portion 52*a* (a resin supply portion) that feeds the temporarily stored additive to the pipe 54. The output portion 52*a* includes a feeder (not illustrated) that feeds the additive stored in the additive supply portion 52 to the pipe 54 and a shutter (not illustrated) that opens and closes a duct that couples the feeder and the pipe 54 to each other. When the shutter is closed, a duct or an opening that couples the output portion 52*a* and the pipe 54 to each other is closed, and the supply with the additive from the additive supply portion 52 to the pipe 54 is stopped.

When the feeder of the output portion 52*a* is not operated, the additive is not supplied from the additive supply portion 52 to the pipe 54. When a negative pressure is generated in the pipe 54, the additive may flow to the pipe 54 although the output portion 52*a* is stopped. By closing the output portion 52*a*, such a flow of the additive can be reliably blocked.

The additive that is supplied by the additive supply portion 52 includes a resin for binding a plurality of fibers. The resin included in the additive is a thermoplastic resin or a thermosetting resin, and may be, for example, AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyetheretherketone. One of these resins may be used or some of these resins may be mixed and used. That is, the additive may contain a single substance or may be a mixture of some substances; or may contain a plurality of types of particles, each type of particles being constituted of a single substance or a plurality of substances. The additive may be fiber form or powder form.

The resin contained in the additive is melted with heat and binds a plurality of fibers together. Thus, in a state in which a resin is mixed with fibers and the resin is not heated to a melting temperature, the fibers are not bound together.

The additive that is supplied by the additive supply portion 52 may include, in addition to the resin that binds fibers together, a coloring agent for coloring fibers, an anti-aggregation agent that suppresses aggregation of fibers or aggregation of resin, and a flame retardant for making fibers etc. flame-resistant, in accordance with the type of a sheet to be manufactured. The additive not including a coloring agent may be colorless, may have a light color by a certain degree that seems to be colorless, or may be white.

With the airflow generated by the mixing blower 56, the subdivided bodies P descending through the pipe 7 and the additive supplied by the additive supply portion 52 are sucked into the pipe 54 and pass through the mixing blower 56. Using the airflow generated by the mixing blower 56 and/or the action of a rotary portion such as a blade of the mixing blower 56, the fibers which constitute the subdivided bodies P and the additive are mixed together. The mixture (the mixture of the first sorted object and the additive) passes through the pipe 54 and is transferred to the deposition section 60.

The mechanism that mixes the first sorted object and the additive together is not particularly limited and may be a configuration that stirs the first sorted object and the additive by using a blade that rotates at a high speed, or may be a configuration that uses rotation of a container like a V-type mixer. Such a mechanism may be disposed in front or in rear of the mixing blower 56.

The deposition section 60 introduces the mixture which passed through the mixing section 50 from an inlet port 62, disentangles the entangled defibrated object (fibers), and causes the disentangled defibrated object to descend while dispersing the defibrated object in the air. Further, when the resin of the additive to be supplied from the additive supply portion 52 is in a fiber form, the deposition section 60 disentangles the entangled resin. Thus, the deposition section 60 can uniformly deposit the mixture in the second web forming section 70.

The deposition section 60 has a drum portion 61 (a drum) and a housing portion (a cover portion) 63 that houses the drum portion 61. The drum portion 61 is a cylindrical sieve that is rotationally driven by a motor. The drum portion 61 has a net (a filter, a screen) and functions as a sieve. With the mesh of the net, the drum portion 61 allows fibers and particles smaller than the apertures (openings) of the mesh of the net to pass therethrough and to descend from the drum portion 61. The configuration of the drum portion 61 is, for example, the same configuration as the configuration of the drum portion 41.

It is to be noted that the "sieve" of the drum portion 61 may not have the function of sorting a specific object. That is, the "sieve" that is used as the drum portion 61 represents being provided with a net. The drum portion 61 may cause the entirety of the mixture introduced to the drum portion 61 to descend.

The second web forming section 70 is arranged below the drum portion 61. The second web forming section 70 (an web forming section) deposits a passing object which passed through the deposition section 60 and forms a second web W2 (a deposit). The second web forming section 70 has, for example, a mesh belt 72 (a mesh body), a roller 74, and a suction mechanism 76.

The mesh belt 72 is an endless-form belt, is supported by a plurality of rollers 74, and is transported in a direction indicated by an arrow in the drawing by motions of the rollers 74. The mesh belt 72 is made of, for example, metal, resin, fabric, or nonwoven fabric. The mesh belt 72 has a surface that is constituted of a net in which openings with a predetermined size are arrayed. Fine particles having sizes that pass through the mesh of the net and included in the fibers and particles descending from the drum portion 61 fall to a position below the mesh belt 72; and fibers with sizes that do not pass through the mesh of the net are deposited on the mesh belt 72 and are transported in the arrow direction together with the mesh belt 72. The mesh belt 72 moves at a constant speed V2 during a normal operation of manufacturing a sheet S. During an operation represents the above-described period.

The mesh of the net of the mesh belt 72 is a fine mesh and may have a size that most fibers and particles descending from the drum portion 61 do not pass through the mesh.

The suction mechanism 76 is provided below the mesh belt 72 (on the side opposite to the deposition section 60 side). The suction mechanism 76 includes a suction blower 77. With the sucking force of the suction blower 77, a downward airflow (an airflow directed from the deposition section 60 toward the mesh belt 72) can be generated at the suction mechanism 76.

The suction mechanism 76 sucks the mixture dispersed in the air by the deposition section 60 onto the mesh belt 72. Thus, the formation of the second web W2 on the mesh belt 72 is promoted and the output speed from the deposition section 60 can be increased. Furthermore, the suction mechanism 76 can form a downflow in a falling path of the mixture, and can prevent the defibrated object and the additive from being entangled with one another during falling.

The suction blower 77 (a deposit sucking portion) may output the air sucked from the suction mechanism 76 to the outside of the sheet manufacturing apparatus 100 through a collecting filter (not illustrated). Alternatively, the air sucked by the suction blower 77 may be fed to the dust collector 27 to collect the elimination object included in the air sucked by the suction mechanism 76.

The humidifying unit 208 supplies humidifying air to a space including the drum portion 61. The humidifying air can humidify the inside of the deposition section 60, suppress adhesion of the fibers and particles to the housing portion 63 due to static electricity, and allow the fibers and particles to quickly descend onto the mesh belt 72. Hence the second web W2 with a desirable shape can be formed.

As described above, since the process involves passing through the deposition section 60 and the second web forming section 70 (a web forming step), a second web W2 which contains much air and is softly expanded is formed. The second web W2 deposited on the mesh belt 72 is transported to the sheet forming section 80.

In the transport path of the mesh belt 72, the humidifying unit 212 supplies the air including a mist to the downstream side of the deposition section 60. Thus, the mist generated by the humidifying unit 212 is supplied to the second web W2 and the quantity of moisture contained in the second web W2 is controlled. Thus, attraction of fibers to the mesh belt 72 due to static electricity and so forth can be suppressed.

The sheet manufacturing apparatus 100 is provided with the transport section 79 that transports the second web W2 on the mesh belt 72 to the sheet forming section 80. The transport section 79 has, for example, a mesh belt 79*a*, a support roller 79*b*, and a suction mechanism 79*c*.

The suction mechanism 79*c* includes a blower (not illustrated). The sucking force of the blower generates an upward airflow at the mesh belt 79*a*. The airflow sucks the second web W2. The second web W2 is separated from the mesh belt 72 and is sucked to the mesh belt 79*a*. The mesh belt 79*a* moves by rotation of the support roller 79*b*, and transports the second web W2 to the sheet forming section 80. The moving speed of the mesh belt 72 is, for example, the same as the moving speed of the mesh belt 79*a*.

In this way, the transport section 79 peels off the second web W2 formed on the mesh belt 72 from the mesh belt 72 and transports the second web W2.

The sheet forming section 80 applies heat and pressure to the second web W2 deposited on the mesh belt 72 and transported by the transport section 79, to form a sheet S. The sheet forming section 80 applies heat to the fibers of the defibrated object and the additive included in the second web W2 to bind a plurality of fibers in the mixture together via the additive (resin).

The sheet forming section 80 includes a pressing unit 82 that presses the second web W2 and a heating unit 84 that heats the second web W2 pressed by the pressing unit 82. The pressing unit 82 and the heating unit 84 constitute a forming-section roller unit.

The pressing unit 82 is constituted of a pressing roller pair 85 that pinches and presses the second web W2 with a predetermined nip pressure. When the second web W2 is pressed, the thickness of the second web W2 is decreased and the density thereof is increased.

The pressing roller pair 85 is rotated by a driving force of a motor (not illustrated) and transports the second web W2 whose density was increased by the pressure, toward the heating unit 84.

The heating unit 84 may use, for example, a heating roller (a heater roller), a thermal press forming machine, a hot plate, a warm-air blower, an infrared heater, or a flash fixing device. In this embodiment, the heating unit 84 is constituted of a heating roller pair 86. The heating roller pair 86 is heated to a previously set temperature by a heater that is disposed inside or outside the heating roller pair 86. The heating roller pair 86 pinches the second web W2 pressed by the pressing roller pair 85 and applies heat to the second web W2 to form a sheet S.

In this way, the second web W2 formed by the deposition section 60 is pressed and heated by the sheet forming section 80 and becomes a sheet S. The heating roller pair 86 transports the sheet S toward the cutting section 90.

The cutting section 90 (a cutter section) cuts the sheet S formed by the sheet forming section 80. In this embodiment, the cutting section 90 has a first cutting portion 92 that cuts the sheet S in a direction intersecting with the transport direction of the sheet S, and a second cutting portion 94 that cuts the sheet S in a direction parallel to the transport direction. The second cutting portion 94 cuts, for example, a sheet S which passed through the first cutting portion 92.

Thus, a single sheet S with a predetermined size is formed. The single cut sheet S is output to the output section 96. The output section 96 includes a tray or a stacker on which the sheet S with the predetermined size is placed.

In the above-described configuration, the humidifying units 202, 204, 206, and 208 may be constituted of a single vaporizing type humidifier. In this case, the humidifying air generated by the single humidifier may be supplied to the rough crush section 12, the housing portion 43, the pipe 7, and the housing portion 63 in a split manner. The above-described configuration can be easily provided by disposing ducts (not illustrate) for supplying the humidifying air in a split manner. Alternatively, the humidifying units 202, 204, 206, and 208 may be constituted of two or three vaporizing type humidifiers.

In the above-described configuration, the humidifying units 210 and 212 may be constituted of a single ultrasonic type humidifier or two ultrasonic type humidifiers. For example, the air including a mist generated by the single humidifier may be supplied to the humidifying units 210 and 212 in a split manner.

In addition, the blowers included in the above-described sheet manufacturing apparatus 100 are not limited to the defibrating-section blower 26, the collecting blower 28, the mixing blower 56, the suction blower 77, and the blower of the suction mechanism 79*c*. For example, a blower that assists each of the above-described blowers may be provided at a duct.

In addition, in the above-described configuration, the rough crush section 12 roughly crushes the raw material first, and a sheet S is manufactured from the roughly crushed raw material. However, for example, a sheet S may be manufactured by using fibers as a raw material.

For example, fibers equivalent to the defibrated object after the defibrating processing by the defibrator 20 may be input as a raw material to the drum portion 41. Alternatively, fibers equivalent to the first sorted object separated from the defibrated object may be input as a raw material to the pipe 54. In these cases, a sheet S can be manufactured by supplying fibers obtained by processing used paper, pulp, or the like, to the sheet manufacturing apparatus 100.

Next, the suction mechanism 76 of the web forming device is described in detail.

Figure 2:
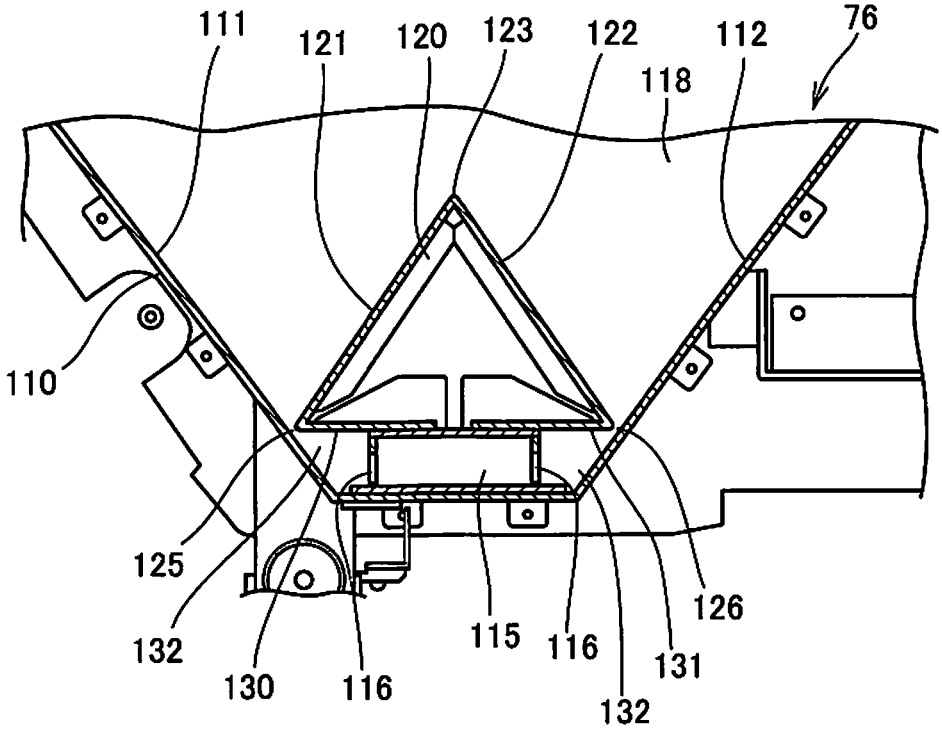
FIG. 2 is a cross-sectional view of a suction mechanism.
Figure 3:
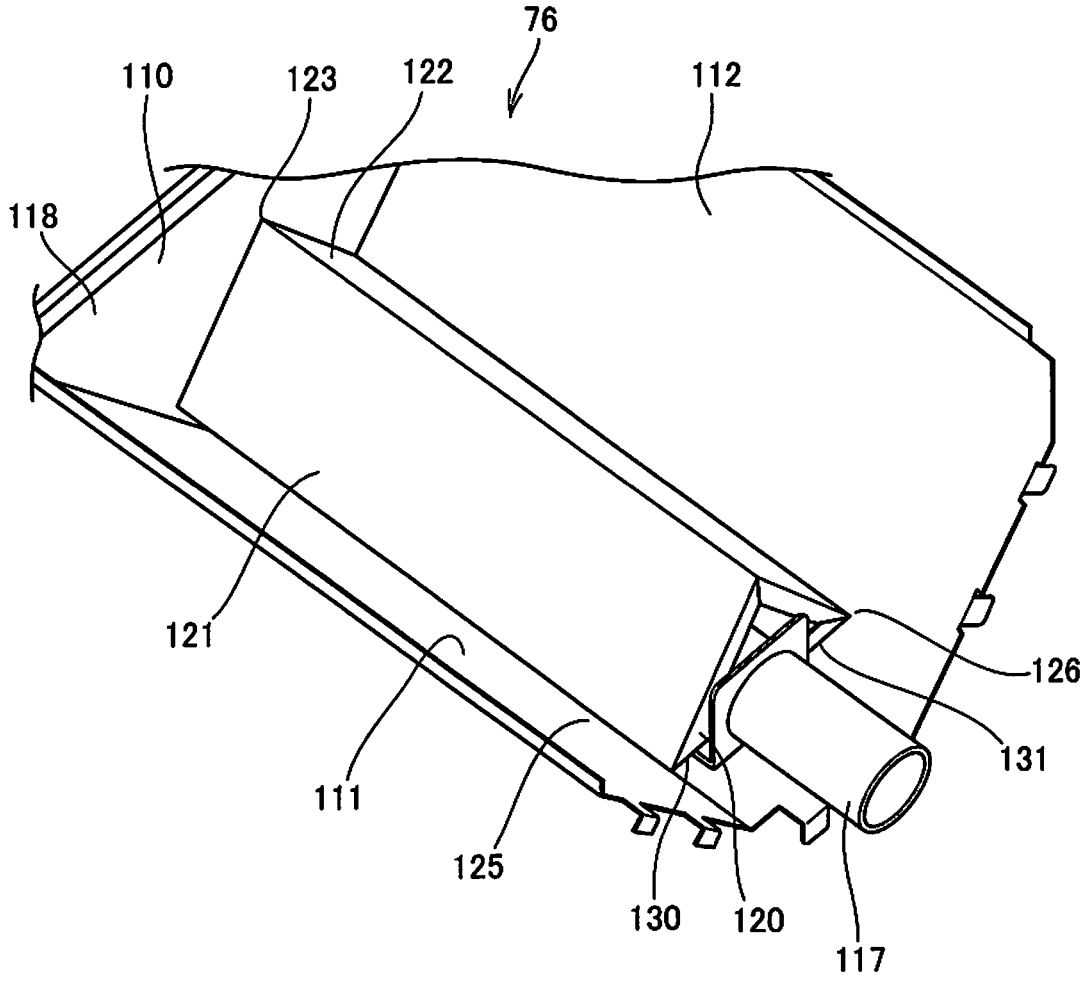
FIG. 3 is a perspective view of the suction mechanism.
Figure 4:
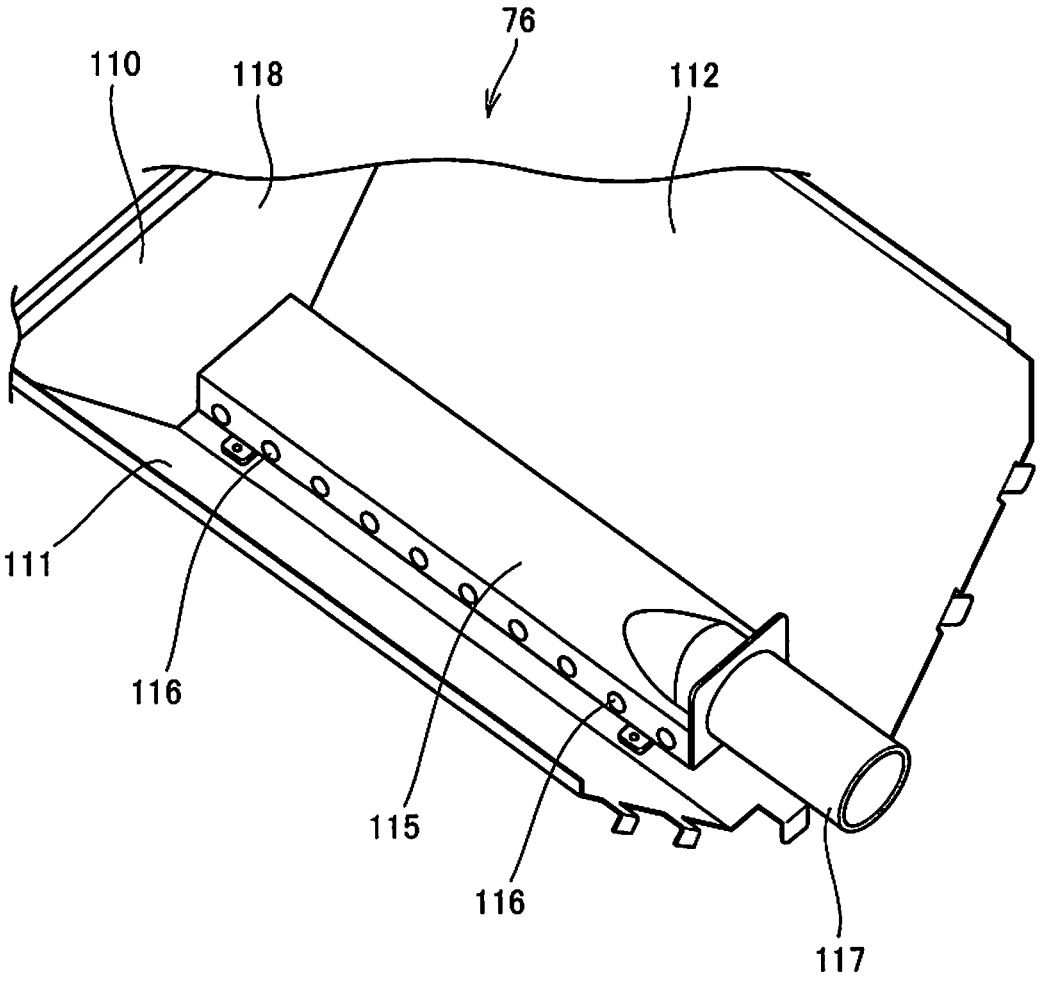
FIG. 4 is a perspective view of a transport box of the suction mechanism.

FIG. 2 is a cross-sectional view of the suction mechanism. FIG. 3 is a perspective view of the suction mechanism. FIG. 4 is a perspective view of a transport box of the suction mechanism.

As illustrated in FIG. 2, the suction mechanism 76 includes a housing portion 110 that has an open upper surface and that is arranged on the back surface side of the mesh belt 72. Both side surfaces 111 and 112 in the transport direction of the mesh belt 72 (the second web W2) of the housing portion 110 are formed in a tapered shape in which the side surfaces 111 and 112 are inclined such that the distance between the side surfaces 111 and 112 decreases downward in the vertical direction. In the following description, the side surfaces 111 and 112 are referred to as a first inclined surface 111 and a second inclined surface 112. Both side surfaces 118 of the housing portion 110 in a direction intersecting with the transport direction of the mesh belt 72 are formed substantially perpendicularly to a bottom surface of the housing portion 110. The side surfaces 118 couple the first inclined surface 111 and the second inclined surface 112 to each other and are arranged along the transport direction of the mesh belt 72.

A transport box 115 serving as a transport member is arranged on the bottom surface of the housing portion 110. The transport box 115 is formed in an elongated box shape extending along the bottom surface of the housing portion 110. A plurality of suction openings 116 (openings) are formed at substantially regular intervals in both side surfaces (surfaces facing the first inclined surface 111 and the second inclined surface 112 of the housing portion 110) of the transport box 115. In addition, a pipe 117 (a suction pipe) is coupled to one end of the transport box 115. The pipe 117 communicates with the suction blower 77 serving as a suction portion.

Figure 5:
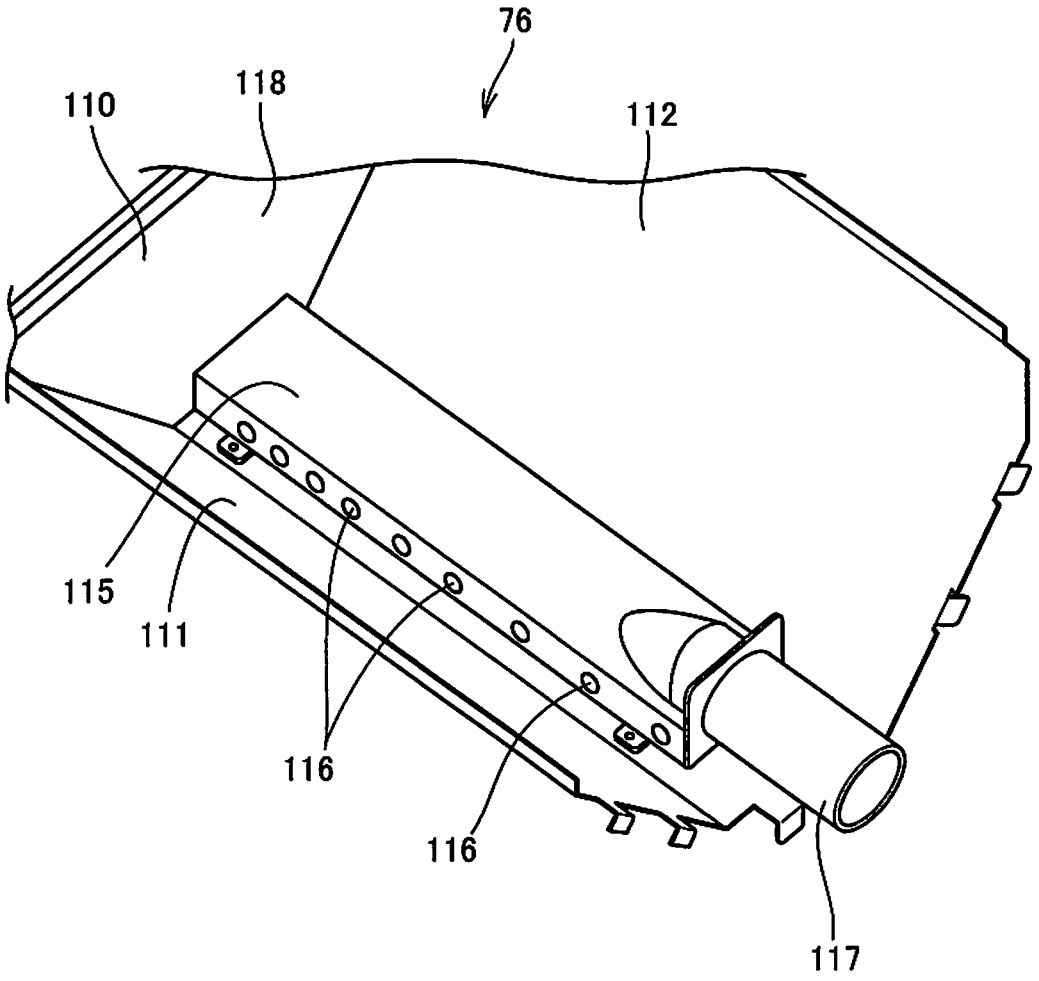
FIG. 5 is a perspective view of another example of the transport box.
Figure 6:
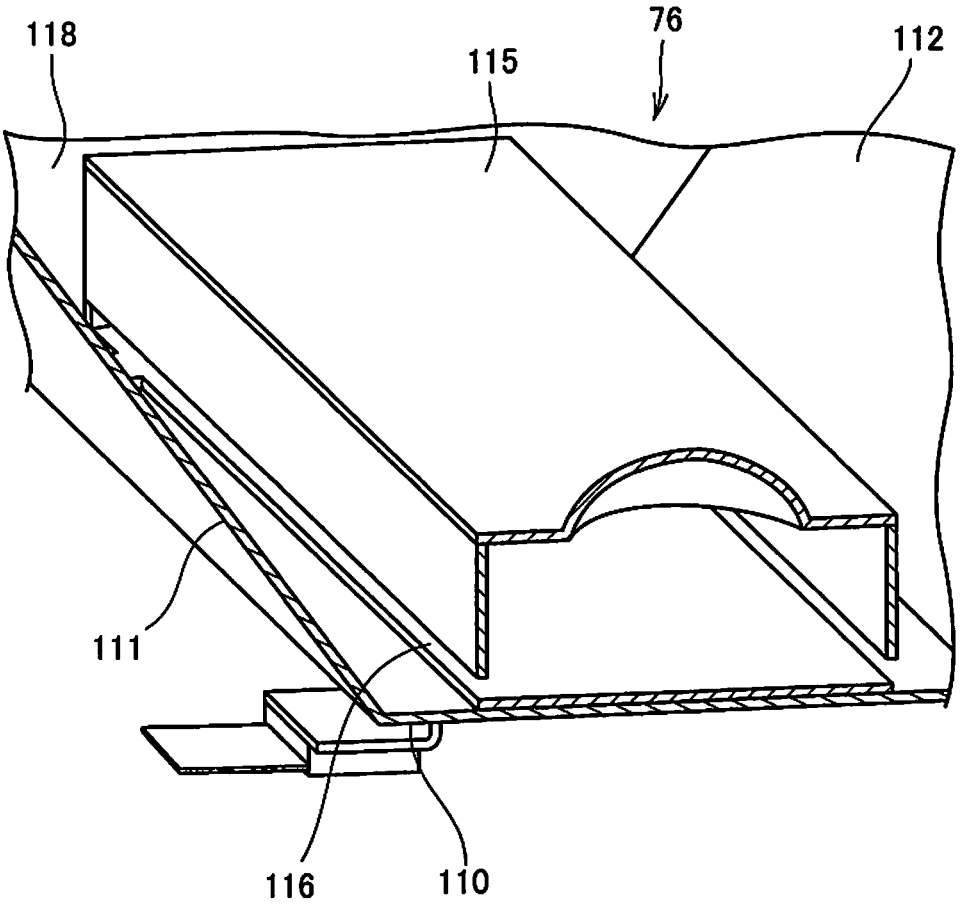
FIG. 6 is a perspective view of still another example of the transport box.

FIG. 5 is a perspective view of another example of the transport box. FIG. 6 is a perspective view of still another example of the transport box.

That is, in the embodiment, the suction openings 116 are formed at substantially regular intervals in the transport box 115; however, it is not limited thereto.

For example, as illustrated in FIG. 5, the suction openings 116 may be formed at irregular intervals. Alternatively, although not illustrated, the suction openings 116 may be formed at regular intervals or irregular intervals, and may have different opening diameters. Still alternatively, the intervals or opening diameters of the suction openings 116 on one side of the transport box 115 may differ from those of the suction openings 116 on the other side. Since the suction openings 116 are formed in this way, for example, when the air is sucked by the suction blower 77, the suction balance of the air in the transport box 115 can be uniform.

Yet alternatively, as illustrated in FIG. 6, slit-shaped suction openings 116 may be formed at both sides of the transport box 115. The suction openings 116 extend in a length direction (a direction intersecting with the transport direction of the mesh belt 72) of the transport box 115. FIG. 6 illustrates an example of forming a single continuous suction opening 116. However, a plurality of slit-shaped suction openings 116 may be formed in the length direction of the transport box 115.

Yet alternatively, by combining the forms in FIGS. 4 to 6, for example, the circular suction opening 116 and the slit-shaped suction opening 116 may be formed.

Figure 7:
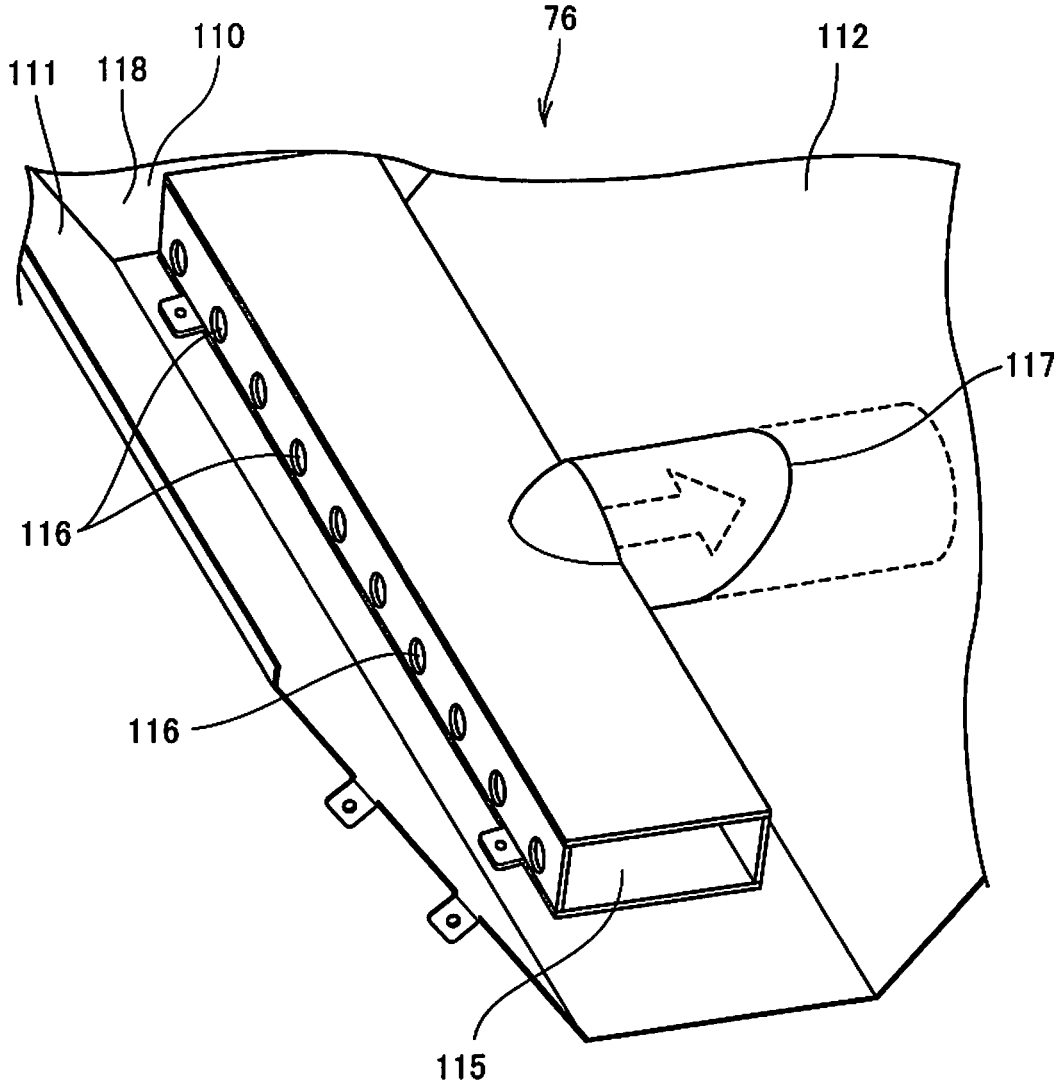
FIG. 7 is a perspective view of yet another example of the transport box.

FIG. 7 is a perspective view of yet another example of the transport box.

In this embodiment, the pipe 117 is coupled to the one end portion of the transport box 115. However, as illustrated in FIG. 7, the pipe 117 may be coupled to a substantially center portion on one side of the transport box 115. Since the pipe 117 is coupled to the substantially center portion of the transport box 115, the suction balance between both sides of the transport box 115 can be uniform.

A roof member 120 having a length dimension substantially similar to the length direction of the transport box 115 is arranged on an upper surface of the transport box 115. The roof member 120 is formed, for example, by bending a planar plate material.

The roof member 120 has a third inclined surface 121 that faces the first inclined surface 111 of the housing portion 110 and that is inclined such that the distance between the first inclined surface 111 and the third inclined surface 121 decreases downward in the vertical direction. A first gap 125 is formed between the first inclined surface 111 of the housing portion 110 and the third inclined surface 121.

In addition, the roof member 120 has a fourth inclined surface 122 that faces the second inclined surface 112 of the housing portion 110 and that is inclined such that the distance between the second inclined surface 112 and the fourth inclined surface 122 decreases downward in the vertical direction. A second gap 126 is formed between the second inclined surface 112 of the housing portion 110 and the fourth inclined surface 122.

Thus, the roof member 120 is formed to have a cross section in an inverted V shape in which the third inclined surface 121 and the fourth inclined surface 122 are coupled to each other in a gable shape at a top portion 123.

The first inclined surface 111, the second inclined surface 112, the third inclined surface 121, and the fourth inclined surface 122 define angles with respect to a horizontal plane (hereinafter, the angles are referred to as inclination angles). The inclination angles each are set to be equal to or larger than the angle of repose of the mixture. In this case, the inclination angles of the first inclined surface 111, the second inclined surface 112, the third inclined surface 121, and the fourth inclined surface 122 each are desirably equal to or larger than the angle of repose of the mixture that passes through the housing portion 110. It is more desirable that the inclination angles of the first inclined surface 111, the second inclined surface 112, the third inclined surface 121, and the fourth inclined surface 122 each are equal to or larger than the angle of repose of a material, the angle of repose being the largest among the angles of repose of materials that constitute the mixture. With this configuration, all the materials that constitute the mixture can fall downward by the first inclined surface 111, the second inclined surface 112, the third inclined surface 121, and the fourth inclined surface 122. The defibrated object that constitutes the mixture is lightweight and hence can be easily sucked. Hence, in this embodiment, the inclination angles of the first inclined surface 111, the second inclined surface 112, the third inclined surface 121, and the fourth inclined surface 122 each are set to be equal to or larger than the angle of repose of the resin that constitutes the mixture.

In this embodiment, the first inclined surface 111, the second inclined surface 112, the third inclined surface 121, and the fourth inclined surface 122 are defined by planar inclined surfaces; however, it is not limited thereto. For example, the first inclined surface 111, the second inclined surface 112, the third inclined surface 121, and the fourth inclined surface 122 may be defined by curved inclined surfaces.

The first gap 125 and the second gap 126 are set to lengths that can provide orifice effect. To be specific, the first gap 125 and the second gap 126 each are set to, for example, 5 mm.

The applicant measured the estimated wind speed of the air flowing through the first gap 125 and the second gap 126 when the first gap 125 and the second gap 126 were set to 5 mm and 6 mm.

Regarding the results, the estimated wind speed when the gap length was 6 mm was 7.6 m/s, and the estimated wind speed when the gap length was 5 mm was 9.1 m/s. It is found that the estimated wind speed is insufficient when the gap length is 6 mm, and a sufficient estimated wind speed can be obtained when the gap length is 5 mm.

The wind speed when the air flows through the first gap 125 and the second gap 126 changes also in accordance with the size of the housing portion 110 and the material that constitutes the mixture. Hence the gap length is not limited thereto. Moreover, the gap length on the upstream side in the transport direction of the mesh belt 72 may differ from the gap length on the downstream side. That is, the gap length of the first gap 125 may differ from the gap length of the second gap 126.

The roof member 120 includes a first partition wall 130 that extends from an end portion of the third inclined surface 121 near the first gap 125 toward the transport box 115, and a second partition wall 131 that extends from an end portion of the fourth inclined surface 122 near the second gap 126 toward the transport box 115. The first partition wall 130 and the second partition wall 131 are disposed in contact with the upper surface of the transport box 115.

In this embodiment, the first partition wall 130 (a first partition surface) is integrally formed with the third inclined surface 121, and the second partition wall 131 (a second partition surface) is integrally formed with the fourth inclined surface 122. As illustrated in FIG. 2, the inclined surfaces 121 and 122 and the partition walls 130 and 131 are formed by bending a flat-plate-shaped plate material in a triangular tube shape. In this case, a gap is provided between the first partition wall 130 and the second partition wall 131 so that the position of a ridge portion between the third inclined surface 121 and the first partition wall 130 and the position of a ridge portion between the fourth inclined surface 122 and the second partition wall 131 can be adjusted. With this configuration, when the roof member 120 is disposed in the housing portion 110, the first gap 125 and the second gap 126 each can be adjusted to be a proper value (in this embodiment, 5 mm).

With the first partition wall 130 and the second partition wall 131, spaces 132 are formed below the first gap 125 and the second gap 126. The spaces 132 are defined by the first inclined surface 111, the second inclined surface 112, the first partition wall 130, the second partition wall 131, and both side surfaces of the transport box 115.

Since the spaces 132 are formed below the first gap 125 and the second gap 126, convection of the air which passed through the first gap 125 and the second gap 126 is generated in the spaces 132. Hence, the mixture is stirred in the spaces 132 and the mixture can be easily sucked from the suction openings 116.

Next, an operation of the suction mechanism 76 of this embodiment is described.

When the suction is started first from the pipe 117 by driving the suction blower 77, the suction from the suction openings 116 of the transport box 115 is performed. The air in the housing portion 110 is sucked to the suction openings 116, and at this time, the air flowing through the first gap 125 and the second gap 126 flows at an increased wind speed by the orifice effect.

Then, the mixture which is included in the mixture falling on the mesh belt 72, which is not deposited as the second web W2 on the mesh belt 72, and which passed through the mesh of the mesh belt 72 falls in the housing portion 110.

The mixture which fell in the housing portion 110 is collected at two positions of the space between the first inclined surface 111 of the housing portion 110 and the third inclined surface 121 of the roof member 120, and the space between the second inclined surface 112 and the fourth inclined surface 122.

The inclination angles of the first inclined surface 111, the second inclined surface 112, the third inclined surface 121, and the fourth inclined surface 122 each are equal to or larger than the angle of repose of a material, the angle of repose being the largest among the angles of repose of materials that constitute the mixture. Hence, the mixture which fell in the housing portion 110 can quickly fall toward the first gap 125 and the second gap 126.

As described above, since the wind speed is increased at the first gap 125 and the second gap 126, the mixture which fell to the first gap 125 and the second gap 126 passes through the first gap 125 and the second gap 126 at a high speed. The mixture which passed through the first gap 125 and the second gap 126 is fed to the spaces 132. Since convection of the air which passed through the first gap 125 and the second gap 126 is generated in the spaces 132, the mixture is stirred and is sucked from the suction openings 116. At this time, since the plurality of suction openings 116 are provided in both side surfaces of the transport box 115, the mixture can be uniformly sucked in the entire region in a width direction (a direction intersecting with the transport direction of the mesh belt 72) of the housing portion 110.

The mixture which was sucked from the suction openings 116 into the transport box 115 is fed to a predetermined position through the pipe 117.

As described above, with the embodiment to which the invention is applied, a mesh belt 72 (a mesh body) that has a deposition surface on which a mixture including a defibrated object and a resin is deposited as a web and that transports a deposited second web (a web) is provided. A housing portion 110 located on a back surface side of the deposition surface of the mesh belt 72 and defining a suction region, and a suction blower 77 (a suction portion) that sucks air in the housing portion 110 are provided. The housing portion 110 includes a first inclined surface 111 and a second inclined surface 112 inclined such that a distance between the first inclined surface 111 and the second inclined surface 112 decreases downward in a vertical direction and arranged to face each other. A third inclined surface 121 that is located between the first inclined surface 111 and the second inclined surface 112, that faces the first inclined surface 111, that is inclined such that a distance between the third inclined surface 121 and the first inclined surface 111 decreases downward in the vertical direction, and that has a first gap 125 with respect to the first inclined surface 111 is provided. A fourth inclined surface 122 that is located between the first inclined surface 111 and the second inclined surface 112, that faces the second inclined surface 112, that is inclined such that a distance between the fourth inclined surface 122 and the second inclined surface 112 decreases downward in the vertical direction, and that has a second gap 126 with respect to the second inclined surface 112 is provided. The suction blower 77 causes the mixture which passed through a mesh of the mesh belt 72 to pass through the first gap 125 or the second gap 126 and collects the mixture.

Accordingly, when the suction blower 77 sucks the air, the wind speed at the first gap 125 and the second gap 126 is high. Hence, the mixture that falls to the first gap 125 and the second gap 126 passes through the first gap 125 and the second gap 126 at a high speed and can be collected. Thus, the mixture is not deposited in the housing portion 110, and a uniform flow of the air can be generated in the housing portion 110. Consequently, the mesh belt 72 can be uniformly sucked, and the second web can be uniformly deposited on the mesh belt 72.

Also, according to this embodiment, inclination angles of the first inclined surface 111, the second inclined surface 112, the third inclined surface 121, and the fourth inclined surface 122 each are equal to or larger than an angle of repose of the mixture.

Accordingly, the mixture which fell on the first inclined surface 111, the second inclined surface 112, the third inclined surface 121, and the fourth inclined surface 122 can quickly fall in the first gap 125 and the second gap 126.

Also, according to this embodiment, inclination angles of the first inclined surface 111, the second inclined surface 112, the third inclined surface 121, and the fourth inclined surface 122 each are equal to or larger than an angle of repose of a material, the angle of repose being the largest among angles of repose of materials that constitute the mixture.

Accordingly, the mixture which fell on the first inclined surface 111, the second inclined surface 112, the third inclined surface 121, and the fourth inclined surface 122 can quickly fall in the first gap 125 and the second gap 126.

Also, according to this embodiment, a transport box 115 (a transport member) communicating with the suction blower 77 through a pipe 117 and having a suction opening 116 (an opening) through which the mixture which passed through the first gap 125 and the second gap 126 passes is provided on a bottom portion of the housing portion 110.

Accordingly, the mixture which passed through the first gap 125 and the second gap 126 at a high speed can be sucked through the suction opening 116 of the transport box 115.

Also, according to this embodiment, the housing portion 110 includes a first partition wall 130 extending from an end portion of the third inclined surface 121 near the first gap 125 toward the transport member. A second partition wall 131 extending from an end portion of the fourth inclined surface 122 near the second gap 126 toward the transport box 115 (the transport member) is provided.

Accordingly, the first partition wall 130 and the second partition wall 131 define the spaces 132 directly below the first gap 125 and the second gap 126. Hence, the mixture which passed through the first gap 125 and the second gap 126 can be stirred, and the mixture can be easily sucked.

Also, according to this embodiment, the third inclined surface 121 and the fourth inclined surface 122 are constituted of a roof member 120 in which the third inclined surface 121 and the fourth inclined surface 122 are coupled to each other in a gable shape at a top portion 123.

Accordingly, with the roof member 120, the third inclined surface 121 and the fourth inclined surface 122 can be integrally formed. In addition, the mixture is not deposited on the top portion 123 between the third inclined surface 121 and the fourth inclined surface 122.

Next, a second embodiment of the invention is described.

Figure 8:
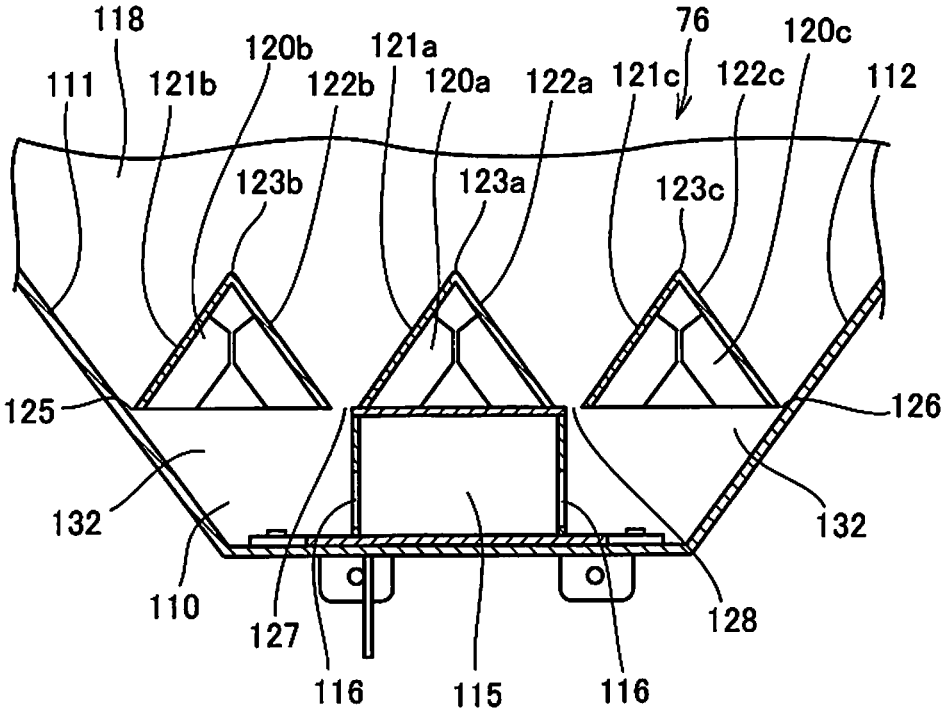
FIG. 8 is a cross-sectional view illustrating roof member parts of a second embodiment.
Figure 9:
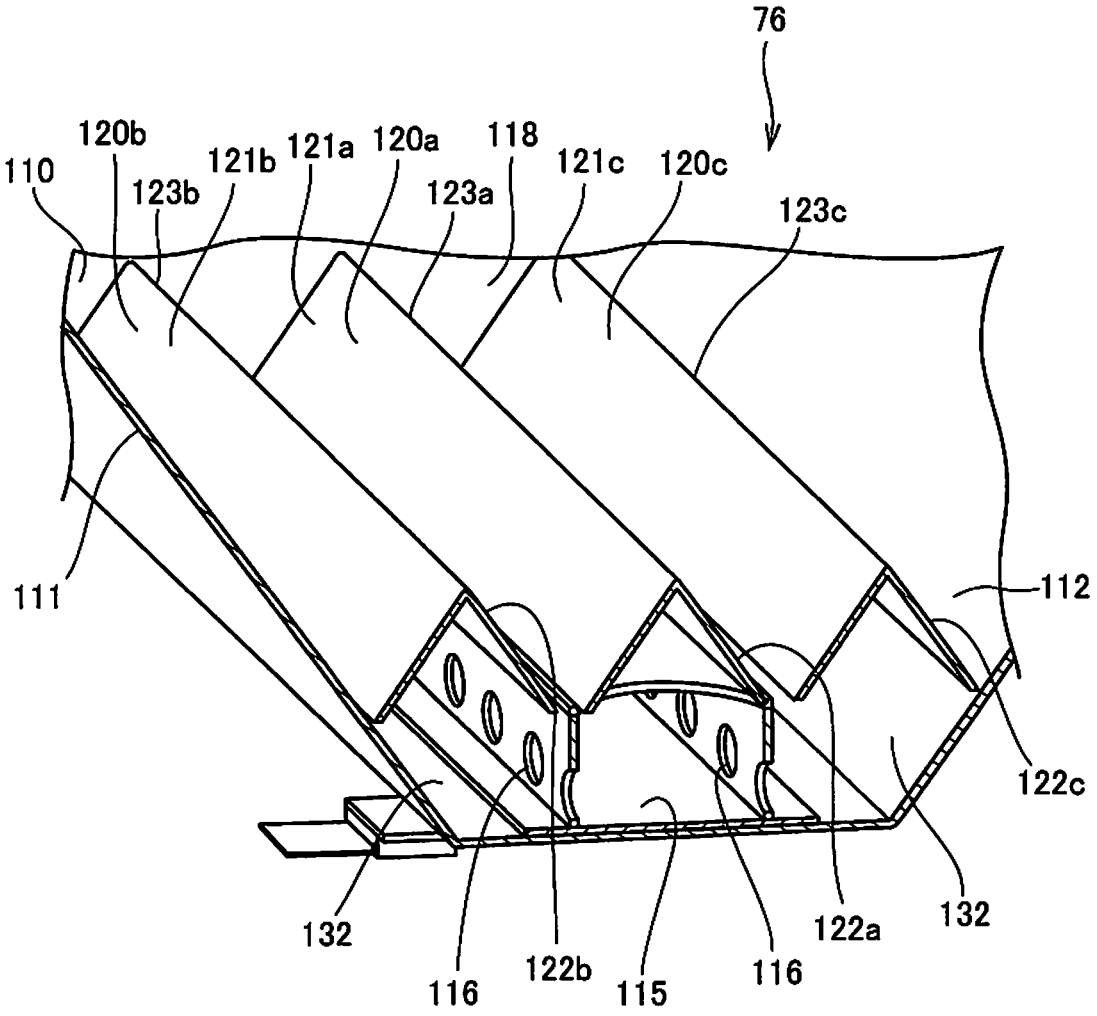
FIG. 9 is a perspective view illustrating the roof member parts of the second embodiment.

FIG. 8 is a cross-sectional view illustrating roof member parts of the second embodiment. FIG. 9 is a perspective view illustrating the roof member parts of the second embodiment.

As illustrated in FIGS. 8 and 9, in this embodiment, a plurality of (in this embodiment, three) roof members 120*a*, 120*b*, and 120*c* are provided above a transport box 115.

The roof members 120*a*, 120*b*, and 120*c* are arrayed along the transport direction of the mesh belt 72. More specifically, the roof member 120*a* is arranged above the transport box 115, and the roof members 120*b* and 120*c* are arranged on both sides of the roof member 120*a*.

The roof members 120*a*, 120*b*, and 120*c*, like the first embodiment, respectively include third inclined surfaces 121*a*, 121*b*, and 121*c* and fourth inclined surfaces 122*a*, 122*b*, and 122*c*; and each have a cross section in an inverted V shape in which the third inclined surfaces 121*a*, 121*b*, and 121*c* are coupled to the fourth inclined surfaces 122*a*, 122*b*, and 122*c* at top portions 123*a*, 123*b*, and 123*c*, respectively.

Like the first embodiment, a first gap 125 is formed between the first inclined surface 111 of the housing portion 110 and the third inclined surface 121*b* of the roof member 120*b* on the left side in FIG. 8. In addition, a second gap 126 is formed between the second inclined surface 112 of the housing portion 110 and the fourth inclined surface 122*c* of the roof member 120*c* on the right side in FIG. 8.

In addition, a predetermined gap is provided between the adjacent roof members 120*a* and 120*b*, and a predetermined gap is provided between the adjacent roof members 120*a* and 120*c*. That is, in FIG. 8, a third gap 127 is formed between the fourth inclined surface 122*b* of the roof member 120*b* on the left side and the third inclined surface 121*a* of the roof member 120*a* at the center; and a fourth gap 128 is formed between the third inclined surface 121*c* of the roof member 120*c* on the right side and the fourth inclined surface 122*a* of the roof member 120*a* at the center. In this way, in this embodiment, the four gaps from the first gap 125 to the fourth gap 128 are formed and the length of each of the gaps is set to 5 mm.

In this embodiment, partition walls are not provided on lower portions of the roof members 120*a*, 120*b*, and 120*c* unlike the first embodiment; however, spaces 132 are formed below the roof members 120*b* and 120*c* located on both sides like the first embodiment. Since the spaces 132 are formed below the first gap 125 to the fourth gap 128, convection of the air which passed through the first gap 125 to the fourth gap 128 is generated in the spaces 132.

Alternatively, partition walls may be provided on the lower portion of the roof members 120*a*, 120*b*, and 120*c*. In this embodiment, while the example in which the three roof members 120*a*, 120*b*, and 120*c* are provided is described, two, or four or more roof members may be provided.

The other configurations are similar to those of the first embodiment. The same reference sign is applied to the same component and the redundant description is omitted.

Next, an operation of this embodiment is described.

Also in this embodiment, like the first embodiment, when the suction is started first from the pipe 117 by driving the suction blower 77, the suction is performed from the suction openings 116 of the transport box 115. The air in the housing portion 110 is sucked to the suction openings 116, and at this time, the air flowing through the first gap 125 to the fourth gap 128 flows at an increased wind speed by the orifice effect.

Then, the mixture which passed through the mesh of the mesh belt 72 and fallen in the housing portion 110 enters the space between the first inclined surface 111 and the third inclined surface 121*b* and the space between the second inclined surface 112 and the fourth inclined surface 122*c*. In addition, the falling mixture enters the space between the third inclined surface 121*a* and the fourth inclined surface 122*b* and the space between the third inclined surface 121*c* and the fourth inclined surface 122*a*. In this embodiment, the mixture is collected at four positions in total.

In addition, since the inclination angles of from the first inclined surface 111 to the fourth inclined surface 122 are equal to or larger than the angle of repose of a material, the angle of repose being the largest among the angles of repose of materials that constitute the mixture, like the first embodiment, the mixture which fell in the housing portion 110 can quickly fall toward the first gap 125 to the fourth gap 128.

As described above, the mixture which fell to the first gap 125 to the fourth gap 128 passes through the first gap 125 to the fourth gap 128 at a high speed.

The mixture which passed through the first gap 125 to the fourth gap 128 is fed to the spaces 132. Since convection of the air which passed through the first gap 125 and the second gap 126 is generated in the spaces 132, the mixture is stirred and is sucked from the suction openings 116.

The mixture which was sucked from the suction openings 116 into the transport box 115 is fed to a predetermined position through the pipe 117.

As described above, with the embodiment to which the invention is applied, the plurality of roof members 120*a*, 120*b*, and 120*c* are arranged side by side. The inclination angles of the facing inclined surfaces 121*a* and 122*b* (a fifth inclined surface and a sixth inclined surface) of the adjacent roof members 120*a* and 120*b* and the inclination angles of the facing inclined surfaces 122*a* and 121*c* (a fifth inclined surface and a sixth inclined surface) of the adjacent roof members 120*a* and 120*c* each are equal to or larger than the angle of repose of the mixture. In addition, the third gap 127 is formed between the facing inclined surfaces 121*a* and 122*b* (the fifth inclined surface and the sixth inclined surface) of the adjacent roof members 120*a* and 120*b* and the fourth gap 128 (a gap) is formed between the facing inclined surfaces 122*a* and 121*c* (the fifth inclined surface and the sixth inclined surface) of the adjacent roof members 120*a* and 120*c*.

Accordingly, when the suction blower 77 sucks the air, the mixture which falls to the first gap 125 to the fourth gap 128 passes through the first gap 125 to the fourth gap 128 at a high speed and can be collected. Thus, the mixture is not deposited in the housing portion 110, and a uniform flow of the air can be generated in the housing portion 110. Consequently, the second web can be uniformly deposited on the mesh belt 72.

The embodiments of the invention have been described above; however, the invention is not limited to the embodiments and can be modified in various ways as required.

For example, in the above-described embodiments, the example has been described in which the invention is applied to the sheet manufacturing apparatus in a dry process. The invention is not limited thereto, and the invention can be applied to, for example, a sheet manufacturing apparatus in a wet process.

REFERENCE SIGNS LIST

10 supply section
20 defibrator
40 sorting section
50 mixing section
60 deposition section
70 second web forming section
72 mesh belt
74 roller
76 suction mechanism
77 suction blower
79 transport section
80 sheet forming section
90 cutting section
100 sheet manufacturing apparatus
110 housing portion
111 first inclined surface
112 second inclined surface
115 transport box
116 suction opening
117 pipe
120 roof member
121 third inclined surface
122 fourth inclined surface
123 top portion
125 first gap
126 second gap
127 third gap
128 fourth gap
130 first partition wall
131 second partition wall
132 space
S sheet
W2 second web

The invention claimed is:

1. A web forming device comprising:

a mesh body that has a deposition surface on which a mixture including a defibrated object and a resin is deposited as a web and that transports the deposited web;

a housing portion located on a back surface side of the deposition surface of the mesh body and defining a suction region; and a suction portion that sucks air in the housing portion, wherein the housing portion includes a first inclined surface and a second inclined surface inclined such that a distance between the first inclined surface and the second inclined surface decreases downward in a vertical direction and arranged to face each other, a third inclined surface that is located between the first inclined surface and the second inclined surface, that faces the first inclined surface, that is inclined such that a distance between the third inclined surface and the first inclined surface decreases downward in the vertical direction, and that has a first gap with respect to the first inclined surface, and a fourth inclined surface that is located between the first inclined surface and the second inclined surface, that faces the second inclined surface, that is inclined such that a distance between the fourth inclined surface and the second inclined surface decreases downward in the vertical direction, and that has a second gap with respect to the second inclined surface, and the suction portion causes the mixture which passed through a mesh of the mesh body to pass through the first gap and the second gap and collects the mixture.

2. The web forming device according to claim 1, wherein a transport member communicating with the suction portion and having an opening through which the mixture which passed through the first gap and the second gap passes is provided on a bottom portion of the housing portion.

3. The web forming device according to claim 2, wherein the housing portion includes a first partition wall extending from an end portion of the third inclined surface near the first gap toward the transport member, and a second partition wall extending from an end portion of the fourth inclined surface near the second gap toward the transport member.

4. The web forming device according to claim 1, wherein inclination angles of the first inclined surface, the second inclined surface, the third inclined surface, and the fourth inclined surface each are larger than an angle of repose of the mixture.

5. The web forming device according to claim 1, wherein inclination angles of the first inclined surface, the second inclined surface, the third inclined surface, and the fourth inclined surface each are larger than an angle of repose of a material, the angle of repose being the largest among angles of repose of materials that constitute the mixture.

6. The web forming device according to claim 1, wherein the third inclined surface and the fourth inclined surface are constituted of a roof member in which the third inclined surface and the fourth inclined surface are coupled to each other in a gable shape at a top portion.

7. The web forming device according to claim 4, wherein a fifth inclined surface and a sixth inclined surface that are located between the third inclined surface and the fourth inclined surface, that are inclined such that a distance between the fifth inclined surface and the sixth inclined surface decreases downward in the vertical direction, and that face each other are provided, and inclination angles of the fifth inclined surface and the sixth inclined surface each are larger than the angle of repose.

8. A sheet manufacturing apparatus comprising:

the web forming device according to claim 1; and a sheet forming section that applies heat and pressure to a web formed by the web forming device and forms a sheet.

9. The web forming device according to claim 5, wherein a fifth inclined surface and a sixth inclined surface that are located between the third inclined surface and the fourth inclined surface, that are inclined such that a distance between the fifth inclined surface and the sixth inclined surface decreases downward in the vertical direction, and that face each other are provided, and inclination angles of the fifth inclined surface and the sixth inclined surface each are larger than the angle of repose.

* * * * *